United States Patent [19]

Arnaud et al.

[11] 3,978,834

[45] Sept. 7, 1976

[54] ARRANGEMENT FOR CONTROLLING THE RECIRCULATION OF EXHAUST GAS IN INTERNAL COMBUSTION ENGINES

[75] Inventors: Henri Arnaud, Antony; Martial Hublin, Cerny; Georges Devaux, Galliene Issy; Claude Lambert, Paris; Henri Milliot, Arpajon, all of France

[73] Assignees: Regie Nationale des Usines Renault; Societe Anonyme dite Automobiles Peugeot, both of Paris, France

[22] Filed: Sept. 25, 1974

[21] Appl. No.: 509,256

[30] Foreign Application Priority Data

Oct. 9, 1973 France ..... 73.36058

[52] U.S. Cl. ..... 123/119 A

[51] Int. Cl.[2] ..... F02M 25/06

[58] Field of Search ..... 123/119 A

[56] References Cited

UNITED STATES PATENTS

| | | | |
|---|---|---|---|
| 3,675,633 | 7/1972 | Nakajima et al. | 123/119 A |
| 3,762,384 | 10/1973 | Day et al. | 123/119 A |
| 3,774,583 | 11/1973 | King | 123/119 A |
| 3,796,049 | 3/1974 | Hayashi | 123/119 A |
| 3,800,764 | 4/1974 | Goto et al. | 123/119 A |
| 3,800,765 | 4/1974 | Thompson | 123/119 A |

*Primary Examiner*—Wendell E. Burns
*Assistant Examiner*—David D. Reynolds
*Attorney, Agent, or Firm*—Oblon, Fisher, Spivak, McClelland & Maier

[57] ABSTRACT

An arrangement for controlling the recirculation of exhaust gases within internal combustion engines, includes a recycling system of conduits connecting the engine exhaust manifold to the main inlet manifold of the carburetion system and having a recirculating valve interposed within such circuit. The obturator of the recirculation valve has a truncated-cone configuration of such design that the increase in the variable area of the opening between the stopper or obturator and its seat is a function of the engine speed and load. In recycling the exhaust gases, the invention serves as an antipollution means for the exhaust gases of internal combustion engines.

14 Claims, 7 Drawing Figures

ARRANGEMENT FOR CONTROLLING THE RECIRCULATION OF EXHAUST GAS IN INTERNAL COMBUSTION ENGINES

BACKGROUND OF THE INVENTION

1. Field of the Invention

The present invention relates generally to internal combustion engines and more particularly to an arrangement for recirculating the exhaust gases of internal combustion engines within which a valve controlled by means of the vacuum within the intake manifold of the engine permits the diversion, depending upon the engine speed and load, of a predetermined amount of the exhaust gases to the inlet manifold so as to be recycled therewithin.

2. Description of the Prior Art

As is known, nitrogen oxides are among the pollutants emitted within the exhaust gases of internal combustion engines and it is also known that in recycling some of the exhaust gases with the fresh mixture entering the engine's inlet manifold the temperature of combustion within the cylinders is lowered, which reduces the formation of nitrogen oxides therewithin, and consequently, the emission of these oxides within the exhaust gases. There is general agreement that recycling exhaust gases through the inlet manifold is necessary only during intermediate load conditions, when large amounts of nitrogen oxides are generated, while such recycling is practically useless when the engine is idling or operating at full load, when such recycling even has the disadvantage of causing some loss of power. It is necessary therefore to utilize an arrangement for controlling the recirculation of exhaust gases which corresponds to different engine operating conditions.

Arrangements are known for controlling the recirculation of exhaust gases which rely upon a valve within the recirculation path from the exhaust manifold to the inlet manifold of the carburetion system, the obturator of which is caused to open or close by means of a vacuum capsule actuated by means of the vacuum condition prevailing within the main inlet passage of the engine. Also known are means for sensing the vacuum conditions which consist of at least one orifice or slot located within the main intake passage just upstream of the throttle valve so that when the latter is closed, such as for example during idling, such means for sensing the vacuum condition is at atmospheric pressure and will experience a vacuum condition only at intermediate throttle positions, the vacuum becoming too slight within the open position of the throttle, that is, at full load, to act upon the diaphragm of the vacuum capsule of the recirculation system.

The principal disadvantage of these known arrangements is that their sensitivity decreases as engine speed increases, while the temperature within the combustion chambers, and therefore the amount of nitrogen oxides produced, also increases. In addition, with the conventional form of stoppers within the recirculation valve, the control of the gas recirculation is not performed gradually, but to the contrary, the opening and closing of the recirculation path is effected rather abruptly.

SUMMARY OF THE INVENTION

Accordingly, it is an object of the present invention to provide an arrangement which is intended to remedy the aforenoted defects and which comprises a recycling path extending from the engine exhaust manifold to the main intake passage of the carburetion system within which path there is provided a recirculation valve, the oburator of which opens and closes the path and which is normally held closed by means of an elastic means and is caused to open as a result of the variations in the displacement of an elastic membrane secured to the obturator control rod and the opening of a vacuum chamber which is subjected to variations in vacuum conditions prevailing within the intake passage of the carburetion system.

Another object of the present invention is to provide the recirculation valve with an obturator which is advantageously configured like a truncated cone and so designed that the increase in area of the opening between the obturator and its seat is dependent upon engine speed and load, the obturator having a height slightly greater than the diameter of its larger end and which is also essentially equal to three times the diameter of the small end, the obturator being connected by means of its control rod to an elastic membrane of a large diametrical extent and the reciprocal or longitudinal excursion of which is slightly greater than the height of the stopper so as to impart a large lift to the latter, the membrane being actuated by means of the vacuum conditions which depend upon the speed of the engine over a range extending from idling conditions to the highest speeds or maximum engine loads.

Still another object of the present invention is to peripherally clamp the elastic membrane of the recirculation valve between two thermally insulating gaskets disposed upon opposite sides of the membrane, prior to securing the cover of the vacuum chamber to its support means, which may be made of thin sheet metal. Openings, integral with the body of the valve are provided for good diffusion of the heat carried by the exhaust gases passing through the valve, as well as for some ventilation of the valve control rod which is secured to the elastic membrane by means of two cups, between which are clamped two washers, also of thermally insulating material, such cup and washer assemblies likewise being disposed on opposite sides of the elastic membrane, the combination of these means rendering effective thermal protection to the membrane. The thermally insulating material, of which the gaskets and washers clamping the elastic membrane therebetween are composed, may be asbestos.

Yet another object of the present invention is to provide the cover of the recirculation valve vacuum with a central boss upon which the elastic means, for returning the elastic membrane to the position for closing the valve, is retained and guided, the boss also constituting the upper stop of the elastic membrane so as to prevent a larger excursion than is necessary, the lower stop being provided by means of the contact between the upper part of the obturator with its seat.

Yet still another object of the present invention is to provide means for controlling the recirculation valve by vacuum conditions which comprises a vacuum-sensing orifice provided within the wall of the main intake passage just upstream of the throttle valve, the special feature of which consists of its being located at a point about the circumference of the passage which lies between 0° and 45° from the throttle axis. This has the advantage over the known arrangement, wherein the vacuum-sensing orifice is disposed 90° away from the throttle axis, of requiring a larger angular displacement of the throttle valve in order for the latter to sweep across the opening of the vacuum-sensing orifice, such producing a more gradual and sensitive control of the system.

As a preferred variant of the present invention, the means for controlling the recirculation valve by vacuum conditions may also comprise a vacuum take-off at the throat of the carburetor venturi at which location the vacuum develops in a manner similar to that of the air flow to the engine, optimum sensitivity of the control of the system thus being obtained. There is also obtained a significant reduction in the nitrogen oxides at high engine loads, a larger quantity of exhaust gases being recycled at these levels than with known means of vacuum sensing. The arrangement of the present invention thus permits, by simple and less costly means, maximum sensitivity and graduality in metering the volume of exhaust gases reaspirated as a function of the engine operating level, such operating range extending from idle to the highest speeds or maximum loads of the engine.

With these control means, during acceleration, the stopper of the recirculation valve is actuated to its open condition by means of the combined effect of the vacuum prevailing within the main intake passage and directly or indirectly by means of the opening angle of the throttle, the stopper similarly being actuated to its closed condition by means of the elastic return means associated with the elastic membrane. The consequence of this is the undesirable recycling at high speed or full load if the compression of the elastic means for closing the recirculation valve stopper is set too low, or insufficient recycling during acceleration if the compression of this elastic means is set too high. In order to remedy this situation, the vacuum within the engine intake is permitted to modulate the opening area of the recirculation valve only between two positions of throttle opening, these two positions determining a corresponding range of speeds at partial load, outside which the recirculation valve closes the exhaust gas recycling passage.

Exhaust gas recycling control systems are known within which the recirculation valve has associated therewith an electrovalve opened and closed as a result of the action of at least one electric switch operated either by means of a cam incorporated at some point within the carburetor linkage, or by means of the accelerator pedal at its extreme positions, the exhaust gases thus being recirculated only at intermediate speeds and blocked under idle and the highest engine speeds, no flexibility however being provided within the system.

More sophisticated arrangements are also known within which the vacuum condition within the engine inlet manifold actuates, by means of a manometric capsule, a supplementary electric switch provided in series with the switch or switches mentioned above within the activating circuit of the electrovalve so that, although exhaust gas recirculation is blocked during idle and the highest engine speed operation, such is permitted at intermediate speed operation only if the inlet vacuum exceeds a given value, thus, the sensitivity of the arrangement is increased, however this arrangement is nevertheless an all-or-nothing type without continuous or progressive action, the area of passage of the gases through the recirculation valve remaining constant when the latter is open, whatever the transient speed of the engine, it therefore being of primary interest to modulate this recirculation opening area so as to be dependent upon transient engine speeds.

French Pat. No. 2,093,391 filed June 12, 1970 by the present inventors, concerns an improvement in the operating conditions of internal combustion engines as a result of the recirculation of the exhaust gases wherein there is disclosed a recirculation valve within which the lift of the obturator is controlled by means of the combined action of an electrovalve coil and a vacuum capsule actuated by means of the inlet vacuum of the engine, whereby the opening of the valve is a function of the inlet vacuum within the limits determined by the excitation of the solenoid. However, the purpose of that patent is basically different from that of the present invention and, in addition, as the solenoid and the vacuum capsule are mounted one above the other at the upper end of the recirculation valve are directly connected to the control rod of the stopper, the solenoid must be substantial and therefore quite cumbersome in order to be able to raise the entire movable assembly of the valve.

To remedy this situation in accordance with the present invention, an electrovalve is located between the vacuum take-off of the engine intake and the vacuum chamber of the recirculation valve, the electrovalve being caused to close the vacuum line and consequently the exhaust gas recycling path outside the region of intermediate engine loads as a result of the provision at least one electric switch activated by means of the throttle linkage, the lift of the recirculation valve stopper and consequently the change in area of the opening for exhaust gas recycling being modulated within the range of intermediate engine loads by means of the change within the vacuum within the intake depending upon the variations during engine transiencies.

With this arrangement, within which the opening and closing of the recirculation valve are controlled by means of the throttle position only, the spring loading of the obturator can be chosen to be sufficiently weak so that the valve opens as soon as the electric switches permit, the lower limit of the spring loading being set only by the force necessary to seat the obturator tightly enough within its seat corresponding to the recirculation valve closed position.

Thus, one more easily controls the commencement and completion or termination of recirculation since only one parameter is involved in accomplishing such, while still retaining the advantages of sensitivity and graduality associated with the special design of the recirculation valve stopper. Moreover, the location of the vacuum take-off upon the intake manifold provides, in comparison with that upon the wall of the carburetor main intake passage or at the throat of the carburetor venturi, complete independance from the type of carburetor used or the possibility of structural modifications having to be made within it. In addition, as the electrovalve is not integrally formed with the recirculation valve as within French Pat. No. 2,093,391 and therefore does not have to lift the entire movable assembly of the recirculation valve but simply to block or unblock the vacuum line extending to the later, such structure can be modest in power and size.

A further object of the present invention is to provide the means for controlling the electric switch causing the electrovalve to close to be a pivoting wiper incorporated within the throttle control linkage and designed so as to close such switch at the extreme open and closed positions of the throttle, and to open the same at intermediate positions of the throttle.

A still further object of the present invention is to provide a second electric switch which is adapted to be closed by means of the carburetor choke control linkage and which is connected in parallel with the first switch within the electrovalve supply circuit whereby the electrovalve will be closed during engine starting, regardless of the throttle position, at which time exhaust gas recirculation would be unfavorable to efficient operation of the engine.

Within a preferred variant of the realization of the present invention, a vacuum tank is inserted within the vacuum line of the recirculation valve between the inlet manifold and the electrovalve, the vacuum tank being provided with a check valve disposed upon the manifold side, mounted and adjusted in such a manner as to block the outlet upon such side when the inlet manifold vacuum is below a given pressure level of the order, for example, of 300 mbar. This vacuum tank guarantees the availability of sufficient vacuum under all circumstances, in particular during acceleration when the inlet manifold vacuum is below the setting of the recirculation valve. A similar arrangement is also described within French patent application No. 73-12-515, filed Apr. 6, 1973 in the names of the present applicants, concerning a multiple-function control valve utilized within the regulation of the supply of the additional air for postcombustion within the exhausts of internal combustion engines as an anti-pollution means.

BRIEF DESCRIPTION OF THE DRAWINGS

Various other objects, features, and attendant advantages of the present invention will be more fully appreciated as the same becomes better understood from the following detailed description when considered in connection with the accompanying drawings, in which like reference characters designate like or corresponding parts throughout the several views and wherein.

DETAILED DESCRIPTION OF THE PREFERRED EMBODIMENTS

Figure 1:
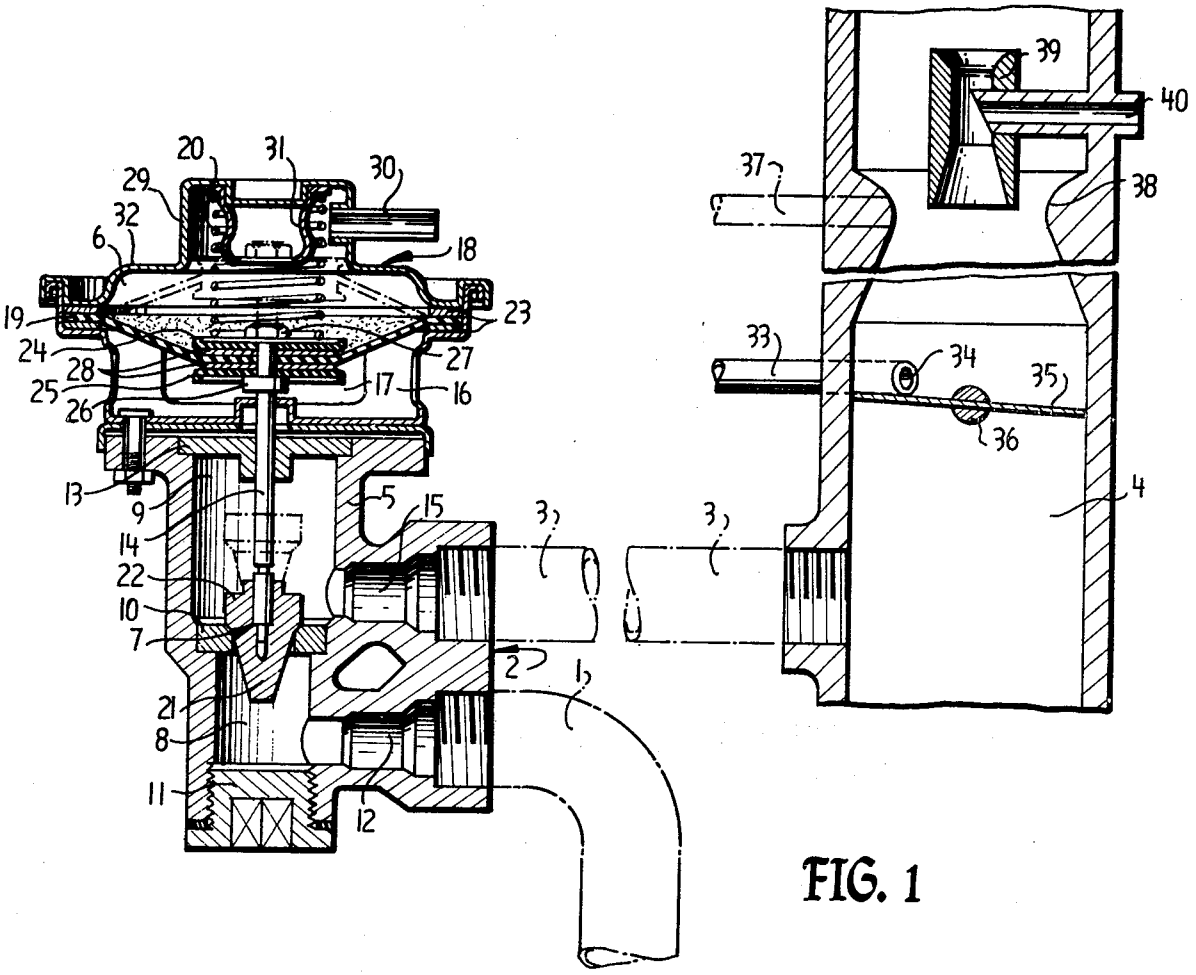
FIG. 1 is a split, cross-sectional view of the recirculation valve of the present invention, as arranged in conjunction with the carburetion system, the stopper of the valve and its control being shown within the closed position in the left half portion of the Figure and in the open position with the right half portion of the Figure.

Referring now to the drawings and more particularly to FIG. 1 thereof, there is disclosed a first recycling passage 1 connecting the exhaust manifold of the engine, not shown, to a recirculation valve 2 and a second recycling passage 3 connecting the recirculation valve 2 to the main intake passage 4 of the carburetion system. The recirculation valve 2 essentially comprises a body 5 and a vacuum chamber 6 for controlling the excursion of the obturator 7 within the path of the recirculating exhaust gases, the body 5 comprising two vertically aligned chambers 8 and 9 separated by means of a transverse seat 10 for the stopper 7. The lower chamber 8, closed at the bottom portion thereof by means of a screw plug 11, communicates with recycling passage 1 by means of a port 12 within the body 5 of valve 2 and the upper chamber 9, the upper portion of which is similarly closed by means of a cover 13 which also defines a central guide bearing for the control rod 14 of stopper 7, communicates with the recycling passage 3 by means of another port 15 within body 5.

The vacuum chamber 6, located within the upper portion of valve 2, is connected to the latter by means of a support 16, which may be made for example of thin sheet metal, threadedly engaged to body 5 and which is provided with large openings 17 in order to provide for sufficient diffusion of the heat carried by the exhaust gases passing through the valve 2 as well as some ventilation for the central control rod 14 of stopper 7. Vacuum chamber 6 further comprises a cover 18 fastened upon the support 16 and an elastic membrane 19 having a large diametrical extent n order to obtain high sensitivity and also being capable of a large excursion so as to render a large lift to stopper 7. The elastic membrane 19, fixed at its periphery by means of the fastening of cover 18 to support 16, abuts a shoulder 26 of control rod 14 whereby the reciprocal movement of membrane is effectively rendered in conjunction with control rod 14, such assembly being normally returned to the position for closure of stopper 7 by means of a spiral compression spring 20 disposed with vacuum chamber 6, the other side of elastic membrane 19 being subjected to atmospheric pressure due to the presence of openings 17 within support 16.

The stopper 7, secured to the lower end of control rod 14, has an effective lower portion 21 which has a trunicated cone configuration and is so designed that the increase in the variable recycling opening area is a function of the engine speed and load. In addition, its height is less than the total excursion of the stopper in order that the opening of seat 10 may be completely clear when the valve opening is maximized as a result of the upward movement of stopper 7 and is slightly greater than the diameter of the large end portion which is essentially equal to three times that of the small end portion. The stopper also includes an upper shoulder 22 for retaining the stopper 7 upon seat 10 when the same closes off the opening within seat 10 when stopper 7 is moved to the position of closure.

In order to effectively insulate membrane 19 from the heat carrier by the exhaust gases and to complement the action of the same within support 16 having the openings 17, the elastic membrane 19 is clamped at its periphery between two asbestos gaskets 23 disposed upon the two sides of the membrane prior to threadedly engaging cover 18 to the support 16, and is also fastened at its central portion to the control rod 14 of stopper 7 by means of two cups, the upper cup 24 being pressed against the lower cup 25 which in turn is pressed against shoulder 26 of control rod 14 by means of a nut 27, two additional asbestos washers 28 being clamped against the two sides of the elastic membrane 19 between cups 24 and 25.

The cover 18 of vacuum chamber 6 also includes a central dome portion 29 into the side of which opens a tube 30 of a vacuum line and from the interior top portion of which there projects downwardly a central internal boss 31 about which one end of the return spring 20 is seated and which also acts as a stop for the upper cup 24 of the elastic membrane 19 and consequently as the upper stop for the lifting action of the stopper 7, the lower stop being the seat 10 with which the upper shoulder 22 of stopper 7 comes into contact.

In a more economical mode of realization or embodiment, not shown within the attached FIGS., the diameter of the dome 29 can be chosen so as to be only slightly larger than that of spring 20 whereby an annular space would be defined between the inner surface of dome 29 and the return spring 20. In this manner, the inner surface of dome 29 is in effect substituted for boss 31 in guiding spring 20 and serving as the upper stop for the upward travel of stopper 7 as a result of upper cup 24 coming into contact with the inner surface of the flat horizontally disposed rim 32 of dome 29 which integrally secures dome 29 to the periphery of cover 18.

The means for controlling the recirculation valve 2 under vacuum conditions comprises a line 33 connected at one thereof to tube 30 which extends into the vacuum chamber 6 and which opens at the other end thereof into the vacuum sensing orifice 34 provided within the side wall of the main intake passage 4 of the carburetion system just upstream of the throttle valve 35 the special feature of which is that such orifice is located between 0° and 45° with respect to the circumference of the throttle 35 from the pivoted axis 36 of the throttle 35.

Figure 2:
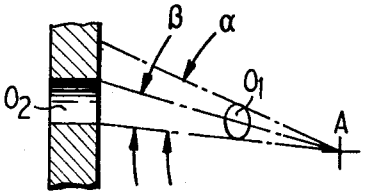
FIG. 2 is a schematic view showing the angular excursion which is necessary for the throttle valve to transverse in sweeping across the opening of the vacuum sensing orifice within the main intake passage of the carburetion system.

As more particularly illustrated within FIG. 2 this location of the orifice $O_1$ for performing the vacuum sensing has the advantage over the conventional arrangement within which the orifice $O_2$, of the same diameter, is located 90° about the circumference of throttle 35 or away from the throttle pivoting axis A, such disposition thereby requiring a larger angular excursion $\alpha$ of the throttle in order to sweep over the surface of the oridice $O_1$ than that $\beta$ for sweeping across the orifice $O_2$, the result being an increase in the gradualness and sensitivity of the control of the recirculation valve 2.

As a preferred variation in the realization of the invention, also shown within FIG. 1, the means for controlling the recirculation valve 2 by vacuum conditions may also comprise a line 37, shown in dashed lines which is connected at one end thereof to the tube 30 of the vacuum chamber 6, in lieu of the line 33 of the preceding example, and which is open at the other end thereof into the throat of the venturi 38 of the main intake passage 4 of the carburetion system at which position the vacuum is greatest for all engine speeds. The vacuum is not sensed at the throat of the diffuser 39 within passage 4 for at such location the vacuum is disturbed as a result of the presence of fuel being introduced through the main fuel feed 40 as it enters the diffuser 39. There is thus very simply obtained sufficient sensitivity for the control of the exhaust gas recirculation which thereby obviates the need for any additional means of amplification which are often required by known arrangements.

Figure 3:
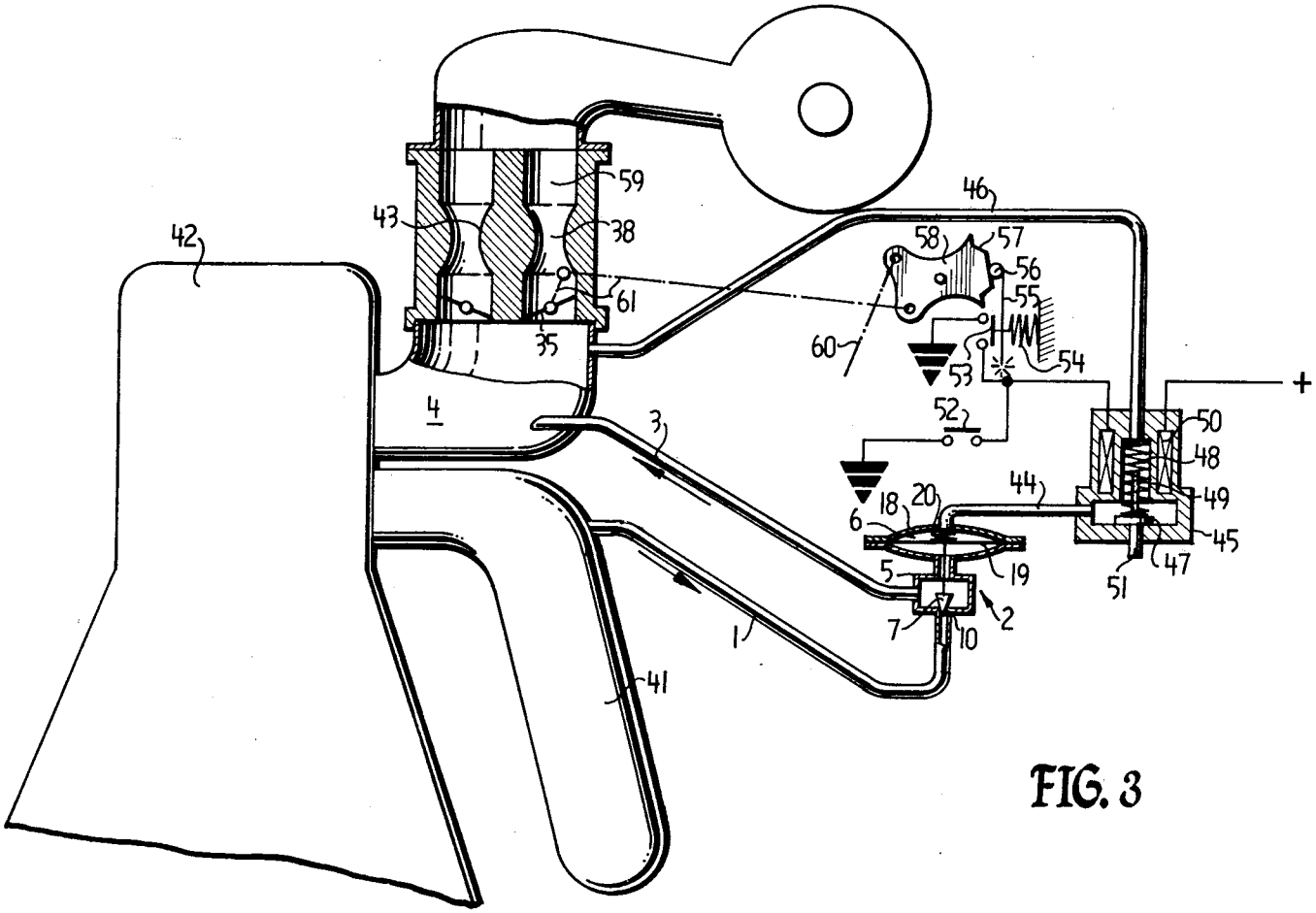
FIG. 3 is a schematic view of another embodiment of the present invention wherein an electrovalve is employed.
Figure 4:
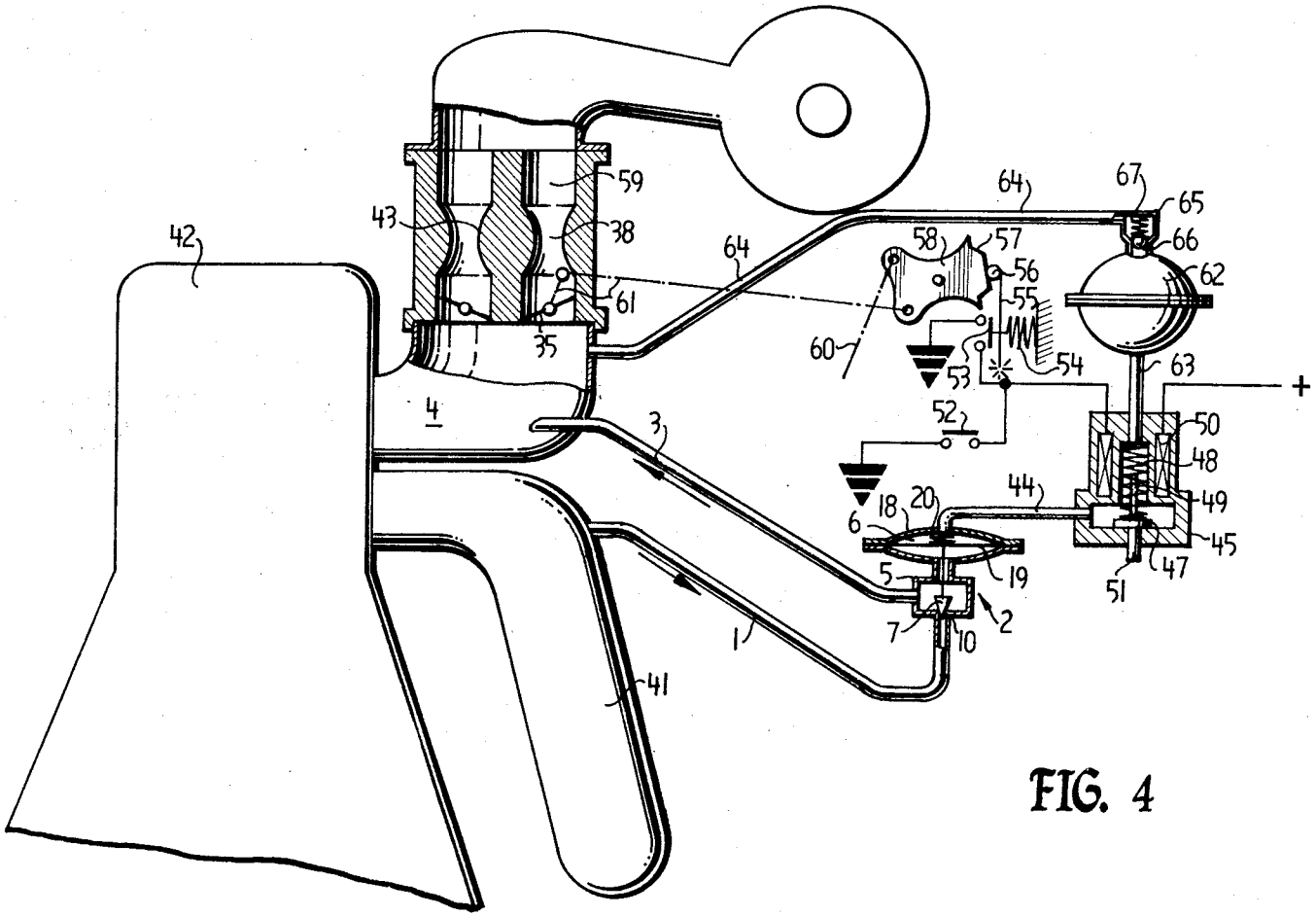
FIG. 4 is a view similar to that of FIG. 3 showing however another embodiment of the present invention within which a vacuum tank is inserted within the vacuum line of the recirculation valve.

Referring now to FIGS. 3 and 4, the embodiments diclosed therein include a first recycling passage 1 connecting the exhaust manifold 41 of engine 42 to the recirculation valve 2 and a second recycling passage 3 connecting valve 2 with the inlet manifold 4 of engine 42. The carburetor 43 is of the two-barrel type, however it is of course apparent that the present invention is also applicable to single-barrel carburetors as well. Only the throttle 35 of the first barrel of the illustrated carburetor will be mentioned throughout the rest of the present description, the throttle of the second barrel being coupled to that of the first by a means appropriate to each carburetor.

As in the preceding mode of realization, the recirculation valve 2 essentially comprises a body 5 having a seat 10 for a stopper 7, and a vacuum chamber 6 closed by means of a membrane 19 which controls the movement of the obturator 7 of the exhaust gas recirculation passage. The means for controlling the recirculation valve 2 under vacuum conditions comprises a line 44 which connects the vacuum chamber 6 to an electrovalve 45 and a line 46 which connects electrovalve 45 to the inlet manifold 4.

The electrovalve 45 includes a disk 47 normally returned to an open position by means of a spring 48 so as to open the passage between lines 44 and 46 and simultaneously block the opening 51 leading to atmosphere. This disk 47 is attached to a core 49 which is attached by means of a solenoid 50 when the latter is excited and when in this closed position, disk 47 blocks the passage between the lines 44 and 46 while simultaneously connecting the line 44, leading to vacuum chamber 6, to atmosphere by means of the opening 51.

The circuit for excitation of solenoid 50 of electrovalve 45 comprises a power supply, a switch 52 disposed upon the starting choke linkage of carburetor 43 and which is turned on in the starting position and is connected in parallel with switch 53 the latter of which is normally returned to the closed position by means of a spring 54 under compression conditions and which is caused to open by means of a lever 55 having a feeler 56 which follows the profile 57 of a pivoting wiper 58 forming part of the control linkage of the throttle 35 which is disposed within the inlet 59 of carburetor 43, the pivoting of wiper 58 being controlled by an element 60 of the general carburetor control mechanism, throttle 35 being connected to wiper 58 by means of control rods 61.

In operation, during cold starting, the closing of the choke of carburetor 43 closes switch 52 and energizes solenoid 50 and consequently stopper 47 is raised so as to block the vacuum line 46 leading from the inlet manifold 4 and subjecting the vacuum chamber 6 to atmospheric pressure which causes spring 20 to force membrane 19 downwardly and thereby close stopper 7 thus blocking the exhaust gas recirculation passage 1, such operations occurring regardless of the position of throttle 35. When the engine is hot, the opening of the choke opens switch 52 thus subjecting, by a reverse process, vacuum chamber 6 to the vacuum conditions prevailing within inlet manifold 4 via line 46 and opening the exhaust gas recirculation path.

During normal engine operation, the profile 57 of wiper 58, for the extreme positions of the throttle 35, that is, for idling and for high speeds or severe loading of the engine, allows switch 53 to close thereby energizing solenoid 50 and closing disk 47 of electrovalve 45 which produces, by a process similar to that as when switch 52 upon the choke linkage is closed, the closing of stopper 7 thus blocking the recirculation of exhaust gases.

For intermediate positions of throttle 35, corresponding to partial loading of the engine, the profile 57 of wiper 58 opens switch 53 upon the accelerator linkage thus deactivating solenoid 50 of electrovalve 45, and by a process similar to that as when switch 52 upon the choke linkage is opened, subjects vacuum chamber 6 to vacuum conditions which consequently opens stopper 7 within the exhaust gas recirculation path. As the engine speed varies, the vacuum within the inlet manifold 4 varies correspondingly and, acting upon the elastic membrane 19 of the vacuum chamber 6, determines the variation in the lift of stopper 7. As the truncated cone configuration of stopper 7 is so designed, as described above, such that the increase in its variable area of opening is a function of engine speed and load, there therefore corresponds to such variation in the lift of the stopper 7 a modulation of the volume of exhaust gases recycled, such thereby determining the best conditions of antipollution and engine operation for each intermediate engine speed.

Referring now more particularly to FIG. 4, there is shown a variant of the preferred embodiment of FIG. 3 of the arrangement of the present invention and within which a vacuum tank 62 is interposed between the inlet manifold 4 and the electrovalve 45 to which tank 62 is respectively connected by means of lines 64 and 63 in lieu of the single line 46 of the embodiment of FIG. 3. The vacuum tank 62 has at its outlet disposed towards the inlet manifold 4 a vacuum check valve 65 with a ball 66 normally returned to the closed position by means of a spring 67, valve 65 being installed and adjusted so as to block line 64 when the vacuum within inlet manifold 4 is below a given pressure level, such as for example of the order of 300 mbar. All other elements within the embodiment of FIG. 4 are identical to those of the embodiment of FIG. 3 and consequently have the same reference numbers.

In operation, as soon as the vacuum within inlet manifold 4 exceeds 300 mbar, the ball 66 of check valve 65 compresses the spring 67 thus subjecting vacuum tank 62 to vacuum conditions. Conversely, when the vacuum within inlet manifold 4 falls below 300 mbar, the spring 67 of check valve 65 reseats the ball 66 so as to block line 64 connecting inlet manifold 4 to vacuum tank 62. Thus the vacuum established within vacuum tank 62 is maintained and the same also permits a constant maintenance of a minimum vacuum level within vacuum chamber 6 so as to thereby impart at least a minimum lift to stopper 7 whereby a predetermined volume of the exhaust gases is recycled regardless of the level of intermediate loading of the engine.

The object arrangement of the present invention therefore permits by simple and inexpensive, but very reliable means, the recirculation of exhaust gases within the required proportions during transient engine conditions, when such recirculation is desirable, and to alternatively block such, with precision, during idling and extreme loading of the engine when such is detrimental to the operation and efficiency of the engine.

The use of the recirculation valve 2 as in the preceding modes of realization in which such valve is controlled by the vacuum conditions sensed within the carburetor or the inlet manifold, poses problems with respect to the tight effective seating of stopper 7 during the idle period. In order to avoid the use of an amplifier for the vacuum conditions, the threshold for the opening of the valve lies below 15 mbar, however, during idle conditions, the inlet manifold vacuum acting upon the stopper 7 through recirculation passage 3 produces a lifting force of the same order of magnitude whereby the stopper 7 practically "floats" which can of course lead to leakage and progressive fouling of seat 10.

Figure 5:
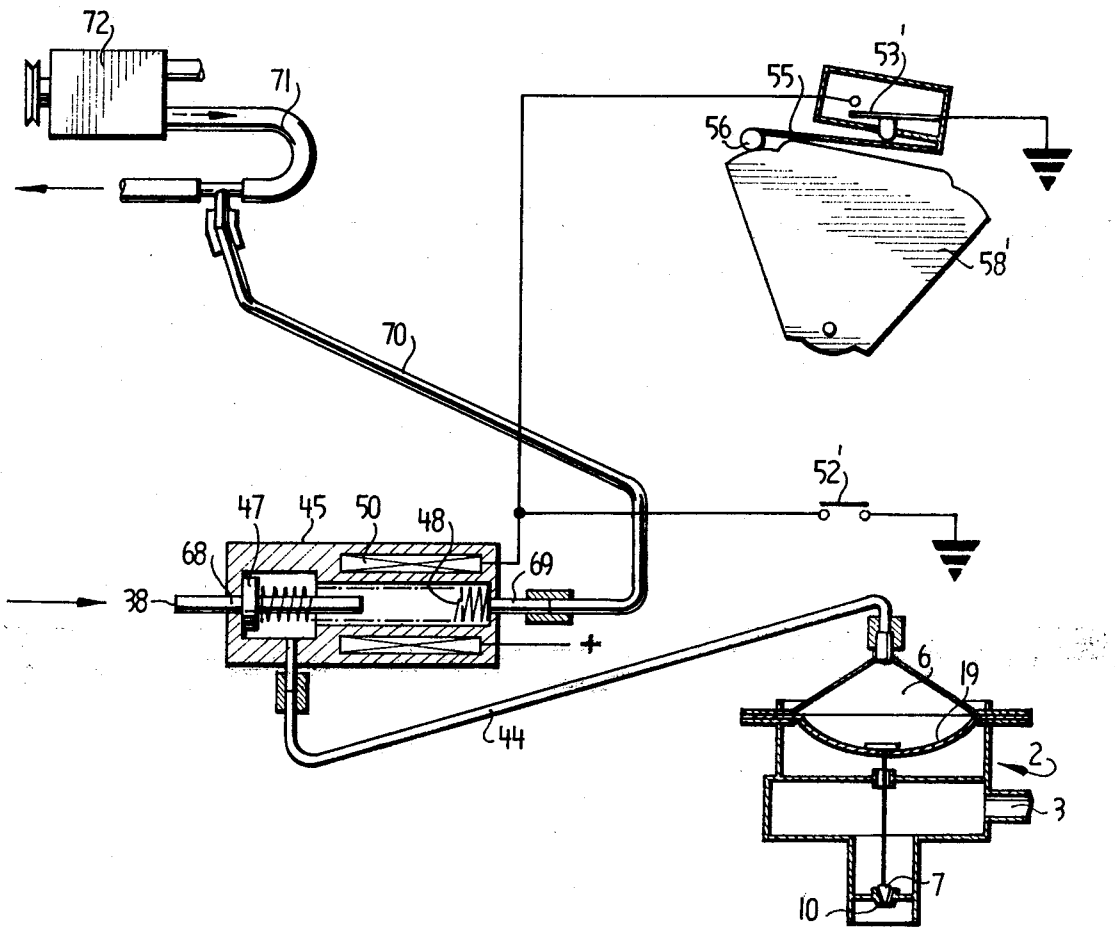
FIG. 5 is a partial schematic view of still another embodiment of the present invention, which is similar to the embodiment shown within FIG. 3, within which however one of the orifices of the electrovalve is connected to the discharge side of an air pump.

In order to eliminate this drawback, another mode of realization of the arrangement of the present invention is shown within FIG. 5 and within which the vacuum chamber 6 of the recycling valve 2 is connected in a manner similar to that shown within the embodiments of FIGS. 3 and 4, by means of a line 44 to electrovalve 45. However, orifice 68 of electrovalve 45 is connected to the throat of the carburetor venturi 38 while orifice 69 is connected by means of a line 70 to the output orifice 71 of an air pump 72. The supply circuit of solenoid 50 of electrovalve 45 is similar to that shown within FIG. 3 in which there is employed, in parallel, a switch 53' controlled by means of a wiper 58' connected to the linkage of throttle 35 of carburetor 43, and a switch 52' disposed upon the choke control of carburetor 43.

When solenoid 50 of electrovalve 45 is not energized spring 48 biases disk 47 toward the left as seen in the Figure so as to close orifice 68 thereby blocking the latter and thus isolating the vacuum chamber 6 of the recirculation valve 2 from the vacuum take-off at the throat of the carburetor venturi 38. On the other hand, chamber 6 is connected by means of line 44, orifice 69 and line 70 to the output orifice 71 of air pump 72 and in this way the output pressure of the air pump is applied to membrane 19 and, consequently, to stopper 7 which is thus kept firmly and maintained against its seat 10 during those periods within which it is desired to eliminate recirculation, such as for example during idling and under extreme loading conditions.

Figure 7:
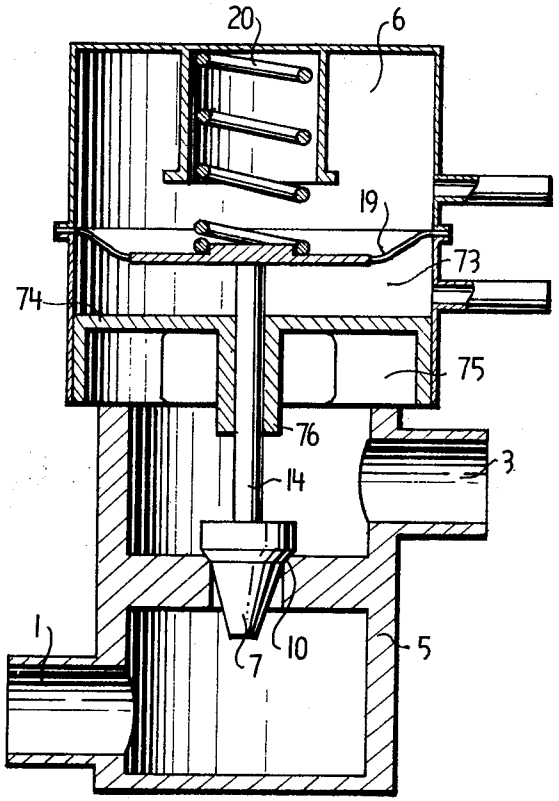
FIG. 7 is a cross-section view of a recirculation valve having two chambers disposed upon opposite sides of the membrane and which is utilized within the system of FIG. 6.
Figure 6:
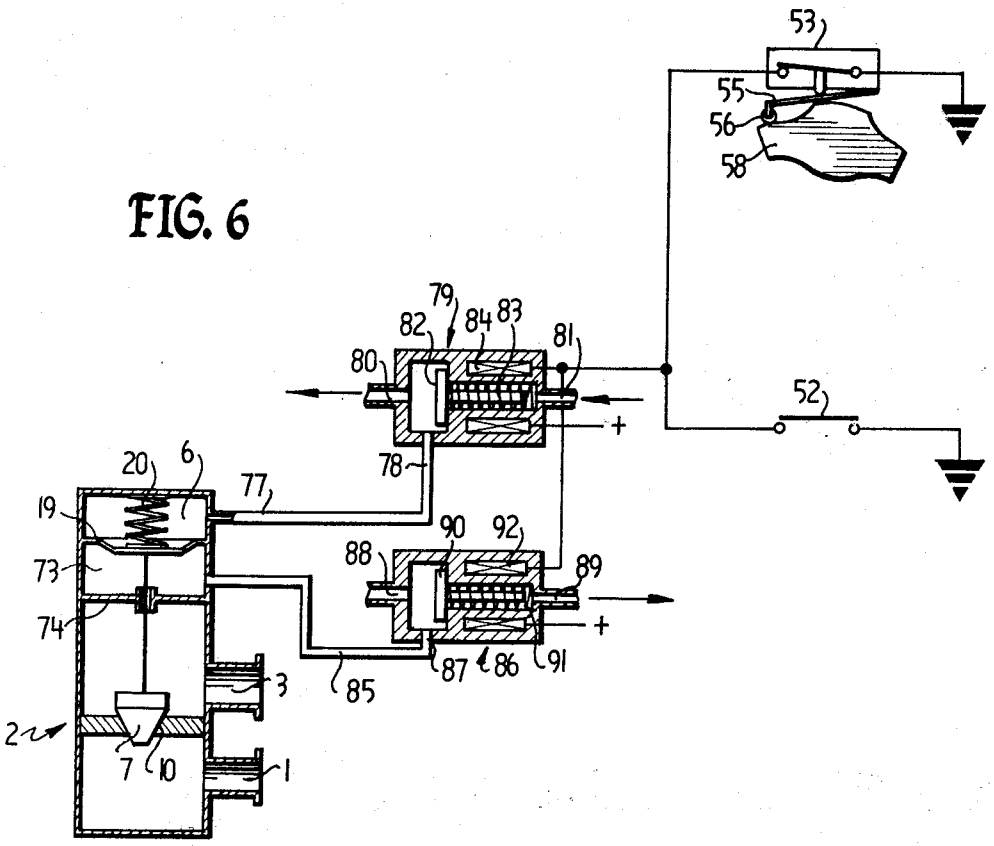
FIG. 6 is a schematic view of yet another embodiment of the present invention wherein the recirculation control valve is connected to two electrovalves.

Referring now to FIGS. 6 and 7, there is shown another mode of realizing the recycling arrangement of the present invention within which it is also possible to maintain stopper 7 firmly against its seat 10 during those periods when recirculation is undesirable, however, this arrangement obviates the use of an air pump. More particularly, the recirculation valve 2, which consists of the same elements as disclosed within the embodiment of FIG. 1, has a second chamber 73 defined between the lower surface of elastic membrane 19 and the upper surface of a wall 74, the chambers 6 and 73 thereby being located upon opposite side of elastic membrane 19. The portion of recirculation valve 2 containing chambers 6 and 73 is connected to the valve body 5 by means of a set of radial vanes 75 and by a guiding member 76 through which the rod 14 of stopper 7 is disposed. The guiding member 76 is of considerable length so as to produce sufficient leakage resistance between rod 14 and guide 76 in order to isolate chamber 73 from the exterior.

The upper chamber 6 is connected by means of a line 77 to an orifice 78 of a first electrovalve 79, an orifice 80 of which is open to atmospheric pressure and an orifice 81 of which is connected to the throat of the carburetor venturi 38. As before, electrovalve 79 has a disk 82 which is subjected to the action of a return spring 83 and a solenoid 84. The lower chamber 73 is connected by means of a line 85 to an orifice 87 of a second electrovalve 86 an orifice 88 of which is connected to the inelt manifold 4 and another orifice 89 of which is open to atmospheric pressure. The electrovalve 86 also has a disk 90 which is acted upon by means of a return spring 91 and a solenoid 92.

The solenoids 84 and 92 of electrovalves 79 and 86 are connected in series within the electrical supply circuit which comprises, as shown within FIGS. 3 and 4, a switch 53 controlled by means of a wiper 58 connected to the linkage of the throttle 35 of carburetor 43, and a parallel arranged switch 52 located upon the choke control of the carburetor 43.

When the feeler 56 is in contact with those parts of the wiper 58 which correspond to the normal operation of the engine at the extreme open and closed positions of the throttle 35, that is, at the positions corresponding to idle and high engine speeds, the switch 53 is closed and the two solenoids 84 and 92 of the electrovalves 79 and 86 are energized at the same time, and similarly when switch 52 is closed. The disks 82 and 90 are in the positions shown within FIG. 6 whereby chamber 6 is connected to atmospheric pressure by means of orifices 78 and 80, and chamber 73 is connected to the vacuum take-off of the inlet manifold 4 through means of orifices 87 and 88.

In this way, the membrane 19 is subjected upon the chamber 6 side thereof to the action of spring 20 and the atmospheric pressure, and upon the chamber 73 side thereof to the action of the vacuum prevailing within the inlet manifold, the result being a strong force being exerted upon the stopper 7 which is thus held firmly against its seat 10. For the intermediate positions of the throttle corresponding to partial loading of the engine, the profile of wiper 58 causes switch 53 to open, the solenoids 84 and 92 of the electrovalves 79 and 86 no longer being energized, and consequently, the disks 82 and 90 close orifices 80 and 88 under the action of springs 83 and 91. The chamber 6 of valve 2 is then connected by orifices 78 and 81 to the throat of the carburetor venturi 38, and chamber 73, by means of orifices 87 and 89, to atmospheric pressure.

As in the preceding modes of realization, there corresponds to variations in engine speeds, variation in the vacuum conditions prevailing within the inlet manifold 4 which, acting upon membrane 19 by means of chamber 6, determines the variation in the lift of stopper 7.

Obviously, many modifications and variations of the present invention are possible in light of the above teachings. It is therefore to be understood that within the scope of the appended claims the invention may be practiced otherwise than as specifically described herein.

What is claimed as new and desired to be secured by Letters Patent of the United States is:

1. An arrangement for controlling the recirculation of exhaust gases within internal combustion engines, a recycling passage connecting the exhaust manifold of said engine to the main intake passage of the carburetion system, and within which is inserted a recirculation valve the obturator of which, effecting the opening and closing of the recirculation circuit and normally returned to the closed position by an elastic means under compression, is actuated to the open condition as a result of the variations in displacement of an elastic membrane which is coupled to a control rod of said obturator and closes off a vacuum chamber which is subjected to the variations in vacuum prevailing within the inlet manifold of said carburetion system, wherein:

said obturator of said recirculation valve has a truncated-cone configuration whereby the increase in the area of the variable opening defined between said stopper or obturator and its seat is a function of the engine speed and load;

said stopper also having a height slightly greater than the diameter of the large end thereof, which is approximately three times that of the small end thereof;

said stopper being secured to said elastic membrane which has a large diametrical extent and the displacement of which is slightly greater than the height of said stopper; and wherein further said membrane is acted upon by a vacuum control system which is dependent upon the speed of rotation of said engine over a range extending from idle condiitions to the highest speeds and maximum loading of said engine, said elastic membrane of said recirculation valve is clamped at its periphery, between two gaskets of thermally insulating material disposed upon opposite sides of said membrane;

said membrane gasket assembly is in turn clamped between a cover of said vacuum chamber and support means integrally formed with the body of said valve;

said support means is provided with a plurality of apertures for providing good diffusion of the heat carrier by said exhaust gases passing through said valve as well as providing ventilation of said control rod of said stopper; and said rod is secured to said elastic membrane by means of two cups, having two washers of thermally insulating material clamped therebetween, disposed upon opposite sides of said elastic membrane.

2. An arrangement for controlling the recirculation of exhaust gases within internal combustion engines as set forth in claim 1, wherein:

said thermally insulating material comprising said gaskets and said washers for clamping said elastic membrane is asbestos.

3. An arrangement for controlling the recirculation of exhaust gases within internal combustion engines as set forth in claim 1, wherein:

said cover of said vacuum chamber of said recirculation valve has a central boss, about which is disposed and guided said elastic return means of said elastic membrane and said stopper, and which also serves as an upper stop for said elastic membrane, the lower stop for which is provided as a result of the contact of the upper portion of said stopper with said seat.

4. An arrangement for controlling the recirculation of exhaust gases within internal combustion engines as set forth in claim 1, wherein said means for controlling said recirculation valve by vacuum comprises:

a vacuum-sensing orifice provided within the side wall of said main intake passage just upstream of the carburetor throttle, said orifice being located at a position angularly disposed around the circumference of said intake passage from the pivotal axis of said throttle between 0° and 45°.

5. An arrangement for controlling the recirculation of exhaust gases within internal combustion engines as set forth in claim 1, wherein said means for controlling said recirculation valve by vacuum comprises:

a vacuum take-off disposed adjacent the throat of the carburetor venturi at which position the vacuum condition is directly proportional to the air flow drawn by said engine.

6. An arrangement for controlling the recirculation of exhaust gases within internal combustion engines as set forth in claim 1, further comprising:

an electrovalve interposed between the vacuum take-off of said inlet manifold of said engine and said vacuum chamber of said recirculation valve and adapted to be energized so as to close said vacuum passage and including atmospheric bleed means for acting upon said membrane and said stopper so as to consequently close said recycling passage for said exhaust gases, external of the range of partial engine loading, by means of at least one electric switch actuated by control linkage means of said throttle, the amount of lift of said stopper of said recirculation valve and consequently the variation in the area of said opening for recycling said exhaust gases thereby being modulated, during partial loading operation of said engine, as a result of the variations within the inlet vacuum as a function of the variations in said engine transient speed.

7. An arrangement for controlling the recirculation of exhaust gases of internal combustion engines as set forth in claim 1, wherein:

the vacuum take-off of said engine intake is located at said inlet manifold.

8. An arrangement for controlling the recirculation of exhaust gases within internal combustion engines as set forth in claim 6, wherein said control linkage means for controlling said electric switch for providing excitation current to said electrovalve within the closed position, comprises:

a pivoting wiper mounted upon said control linkage of said throttle, said wiper having a profile surface configuration which will close said switch when said throttle is in its extreme open and closed positions and which will open said switch when said throttle is within said intermediate positions.

9. An arrangement for controlling the recirculation of exhaust gases within internal combustion engines as set forth in claim 8, further comprising:

a second electric switch actuated to the closed position by means of the control linkage of the engine choke and connected in parallel with said first switch within said supply circuit of said electrovalve.

10. An arrangement for controlling the recirculation of exhaust gases within internal combustion engines as set forth in claim 6, further comprising:

a vacuum tank disposed within said vacuum line between said inlet manifold and said electrovalve.

11. An arrangement for controlling the recirculation of exhaust gases within internal combustion engines as set forth in claim 10, wherein:

said vacuum tank is provided with, within its outlet upon said inlet manifold side, a spring-biased check valve adapted to close said outlet orifice when said vacuum within said inlet manifold is below a predetermined pressure level.

12. An arrangement for controlling the recirculation of exhaust gases within internal combustion engines as set forth in claim 5, wherein:

said electrovalve may be energized so as to open said vacuum line connecting said vacuum chamber of said recirculation valve to said vacuum take-off at said carburetor venturi and de-energized so as to close said vacuum line and connect said vacuum chamber of said recirculation valve to said output line of an air pump.

13. An arrangement for controlling the recirculation of exhaust gases within internal combustion engines as set forth in claim 5, wherein:

said recirculation valve is provided with two chambers disposed upon opposite sides of said elastic membrane, the upper chamber being selectively connected by means of a first electrovalve to atmospheric pressure within the energized state and to said vacuum take-off at said carburetor venturi when de-energized, and the lower chamber being selectively connected by means of a second electrovalve to said vacuum take-off at said inlet manifold within the energized state and to atmospheric pressure when de-energized, the solenoids of said electrovalve being connected in series within said supply circuit containing in parallel said electric switch actuated by means of said control linkage of said throttle and said switch disposed upon said choke control of said carburetor.

14. An arrangement for controlling the recirculation of exhaust gases within internal combustion engines as set forth in claim 13 wherein:

said recirculation valve portion containing said two chambers is secured to said recirculation valve body by means of a set of radial vanes and a guiding member for guiding said rod of said stopper, said guiding member being of substantial length so as to form a seal with said rod.

* * * * *